US010858831B2

(12) United States Patent
Martin et al.

(10) Patent No.: US 10,858,831 B2
(45) Date of Patent: Dec. 8, 2020

(54) REMOVABLE PANEL AND SUSPENDED CEILING INTEGRATING SUCH A REMOVABLE PANEL

(71) Applicant: TEXAA, Gradignan (FR)

(72) Inventors: Guillaume Martin, Rochetoirin (FR); Yannick Lagardere, Lestiac sur Garonne (FR); Charles Lombard, Bordeaux (FR)

(73) Assignee: TEXAA

( * ) Notice: Subject to any disclaimer, the term of this patent is extended or adjusted under 35 U.S.C. 154(b) by 0 days.

(21) Appl. No.: 16/439,050

(22) Filed: Jun. 12, 2019

(65) Prior Publication Data

US 2019/0383011 A1 Dec. 19, 2019

(30) Foreign Application Priority Data

Jun. 13, 2018 (FR) ..... 18 55146

(51) Int. Cl.

| | |
|---|---|
| ***E04B 9/18*** | (2006.01) |
| ***E04B 9/00*** | (2006.01) |
| ***E04B 9/02*** | (2006.01) |
| ***E04B 9/04*** | (2006.01) |

(52) U.S. Cl.

CPC ..... *E04B 9/18* (2013.01); *E04B 9/003* (2013.01); *E04B 9/02* (2013.01); *E04B 9/04* (2013.01); *E04B 2009/0492* (2013.01)

(58) Field of Classification Search

CPC ... E04B 9/003; E04B 9/02; E04B 9/04; E04B 9/0428; E04B 9/18; E04B 9/248; E04B 2009/0492

See application file for complete search history.

(56) References Cited

U.S. PATENT DOCUMENTS

| | | | | |
|---|---|---|---|---|
| 2,834,997 A * | 5/1958 | Webb | E06B 1/04 | 52/204.55 |
| 3,030,670 A * | 4/1962 | Bigelow | E04B 9/26 | 52/650.3 |
| 3,292,328 A * | 12/1966 | Darling | E04B 2/82 | 52/238.1 |

(Continued)

FOREIGN PATENT DOCUMENTS

| | | |
|---|---|---|
| DE | 10253343 | 5/2004 |
| EP | 0976887 | 2/2000 |
| EP | 3293320 | 3/2018 |

OTHER PUBLICATIONS

Preliminary Search Report dated Mar. 12, 2019 for French Application No. 1855146.

*Primary Examiner* — James M Ference
(74) *Attorney, Agent, or Firm* — Perman & Green, LLP

(57) ABSTRACT

A removable panel is provided. The removable panel including a fixed section including a metal fixed section frame, an opening section including a metal opening section frame able to be reversibly nested in the fixed section, at least one magnet that makes it possible to maintain the opening section nested in the fixed section, at least one sling fastened to the fixed section at a first end and reversibly fastened to the opening section at a second end. The removable panel includes at least one safety device able to ensure the fastening of the at least one sling to the opening section.

A suspended ceiling that integrates a removable panel is also provided.

8 Claims, 8 Drawing Sheets

(56) References Cited

U.S. PATENT DOCUMENTS 3,378,974 A * 4/1968 Bush, Jr. ..... E04F 13/0801 52/506.05
3,384,934 A * 5/1968 Bush, Jr. ..... E04B 9/248 24/303
3,816,880 A * 6/1974 Jacobs ..... E04B 9/006 362/150
5,024,034 A * 6/1991 Gailey ..... E04B 9/24 52/506.07
6,701,686 B1 * 3/2004 Platt ..... E04B 9/02 52/506.07
8,056,294 B2 * 11/2011 LaLonde ..... E04B 9/26 52/506.09
9,279,253 B1 * 3/2016 Gaydos ..... E04B 9/34
9,534,383 B1 * 1/2017 Underkofler ..... E04B 9/0478
2003/0046889 A1 * 3/2003 Lynch ..... B44C 5/04 52/506.07
2003/0046890 A1 * 3/2003 Lynch ..... E04B 9/32 52/506.07
2004/0111995 A1 * 6/2004 Dockery ..... E04B 9/205 52/506.08
2004/0118068 A1 * 6/2004 Kliegle ..... E04B 9/225 52/483.1
2008/0259616 A1 * 10/2008 Morgan ..... E04B 9/0464 362/404
2009/0000248 A1 * 1/2009 Waters ..... E04B 9/225 52/800.1
2009/0178358 A1 * 7/2009 Boyd ..... E04B 9/242 52/489.2
2011/0078970 A1 * 4/2011 Boyd ..... E04B 9/248 52/506.07
2011/0252736 A1 * 10/2011 Bailey ..... E04B 9/0478 52/506.07
2014/0265774 A1 * 9/2014 Stewart, Jr. ..... F16M 13/027 312/246
2014/0357177 A1 * 12/2014 Stewart, Jr. ..... F16M 13/027 454/258
2015/0240490 A1 * 8/2015 Firinga ..... E04B 9/12 52/506.05
2017/0044767 A1 * 2/2017 Gloftis ..... E04B 9/18
2017/0130455 A1 * 5/2017 Bergman ..... E04B 9/245
2017/0130456 A1 * 5/2017 Bergman ..... E04B 9/04
2019/0383011 A1 * 12/2019 Martin ..... E04B 9/04

* cited by examiner

REMOVABLE PANEL AND SUSPENDED CEILING INTEGRATING SUCH A REMOVABLE PANEL

CROSS REFERENCE TO RELATED APPLICATIONS

This application claims priority to and the benefit of French Application No. 1855146, filed on 13 Jun. 2018, the disclosure of which is incorporated herein by reference in its entirety.

BACKGROUND

1. Field

The disclosed embodiment belongs to the field of architecture.

More particularly, the disclosed embodiment belongs to the field of suspended ceilings.

2. Brief Description of Related Developments

In addition to aesthetic, thermal and/or acoustic considerations, setting up a suspended ceiling makes it possible to dissimulate in particular the ventilation ducts and the electrical cable raceways by the creation of a technical space, or plenum.

In order to perform maintenance on these technical installations, it is known to use a trapdoor. European patent application EP 0 976 887 for example describes a system comprising a base and a counter-base arranged in sandwich on either side of a trapdoor, and integrated into a suspended ceiling. The dimensions of the base are sufficient to support the trapdoor, while the dimensions of the counter-base are large enough to make it possible to lift and release the trapdoor so as to allow access to the plenum for an operator in charge of maintenance.

A disadvantage of such a system is that it is visually detached from the rest of the suspended ceiling, which can be inconvenient for suspended ceilings for which a uniformity is sought.

American patent U.S. Pat. No. 8,056,294 describes an acoustical suspended ceiling comprising a metal armature intended to receive acoustic panels. The metal armature occasionally has a resilient material that makes it possible to insert or remove an acoustic panel via elastic deformation of said resilient material. The maintaining of the acoustic panel is provided by the resilient material that returns to its initial shape once the panel is set in place.

In alternative embodiments, the resilient material can be implemented on the acoustic panels.

A disadvantage of this system is that this type of installation is able to damage the acoustic panel during the setting in place or the releasing of the panel from the metal armature.

SUMMARY

The disclosed embodiment aims to resolve the disadvantages of prior art.

A removable panel according to the disclosed embodiment comprises:

- a fixed section comprising a metal fixed section frame;
- an opening section comprising a metal opening section frame able to be reversibly nested in said fixed section;

- at least one magnet making it possible to maintain said opening section nested in said fixed section;
- at least one sling fastened to said fixed section at a first end and reversibly fastened to said opening section at a second end;

said removable panel being characterised in that it moreover comprises at least one safety device able to ensure the fastening of the at least one sling to the opening section, said safety device comprising:

- a body of a single piece comprising a fastening portion and a handling portion that are substantially flat substantially forming an angle of 90°, said fastening portion being fastened to the opening section and having a groove that extends perpendicularly to the plane of said handling portion, with rivets being arranged on either side of said groove;
- an arm fastened at a first end to the body by means of one of the rivets in such a way that said arm is able to pivot about the axis of said rivet in order to switch from an open position in which a second end of said arm is free to a closed position in which the other free rivet is engaged in a hole of said second end of said arm or inversely from said closed position to said open position.

In an aspect of the disclosed embodiment, the safety device comprises a gripping portion which allows an operator to grasp said safety device to release the opening section from the fixed section when said opening section is nested in said fixed section.

In an aspect of the disclosed embodiment, the gripping portion has at a free end a means for grasping extending globally perpendicularly to the rest of said gripping portion.

In an aspect of the disclosed embodiment, the fixed section has a bracket section.

The disclosed embodiment also relates to a suspended ceiling comprising a set of modular panels characterised in that it comprises at least one removable panel according to the disclosed embodiment.

In an aspect of the disclosed embodiment, the suspended ceiling is an acoustical suspended ceiling and the modular panels as well as the at least one removable panel are of the type:

- aerated filter panel comprised of a metal armature covered with a perforated textile cover stretched over said armature or;
- absorbent panel comprised of a metal armature that supports an absorbent wadding and a microporous veil, the whole being covered with a textile cover.

In an aspect of the disclosed embodiment, the modular panels are maintained together by linear junction systems that provide a flatness of said suspended ceiling.

BRIEF DESCRIPTION OF THE FIGURES

The disclosed embodiment shall be better understood when reading the following description and when examining the accompanying figures. The latter are shown solely for the purposes of information and in no way limit the disclosed embodiment.

DETAILED DESCRIPTION

Figure 1:
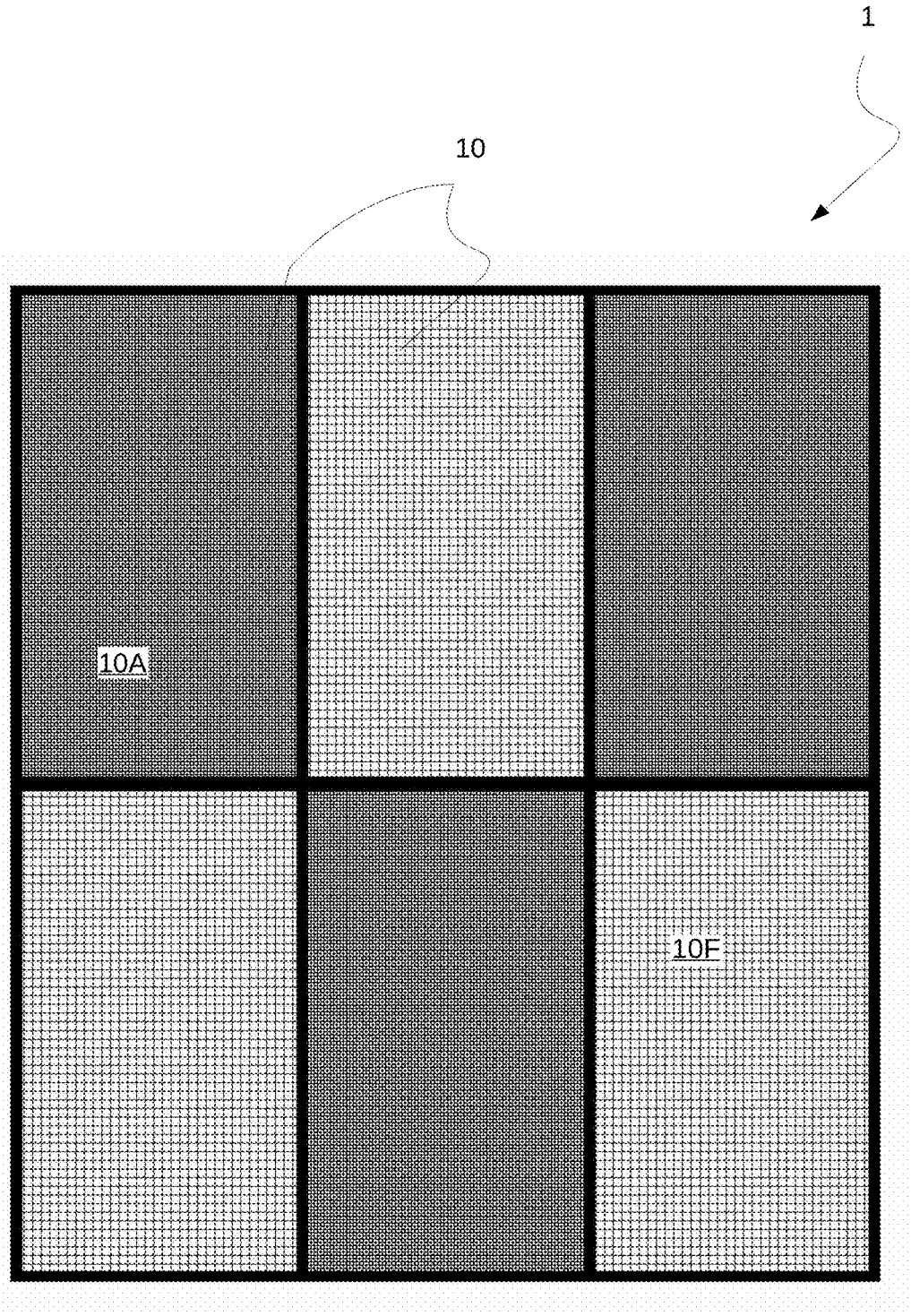
FIG. 1 is a bottom view of an acoustical suspended ceiling in a particular configuration. The acoustical suspended ceiling has filter panels and absorbent panels.

In reference to FIG. 1, an acoustical suspended ceiling 1 is comprised of a set of modular panels 10 that are declined into filter panels 10F and into absorbent panels 10A, respectively referred to in the rest of the description as "filters" and "absorbents". The modular panels 10 are fastened together by linear junction systems 6, which are in turn fastened to the ceiling by a system of cables 2, as shown in FIG. 2.

The filters 10F are acoustic panels comprised of a metal frame covered with a perforated textile cover 11 stretched over said armature. The filters 10F make it possible for example to dim a light source located in a plenum located between the suspended ceiling 1 and a ceiling of a room wherein said suspended ceiling is installed, or to allow the air of an air conditioner to circulate.

The absorbents 10A are opaque elements intended for acoustical correction. The absorbents 10A are panels comprised of a metal frame, of an absorbent wadding and of a microporous veil, the whole being covered with a textile cover 11.

Figure 2:
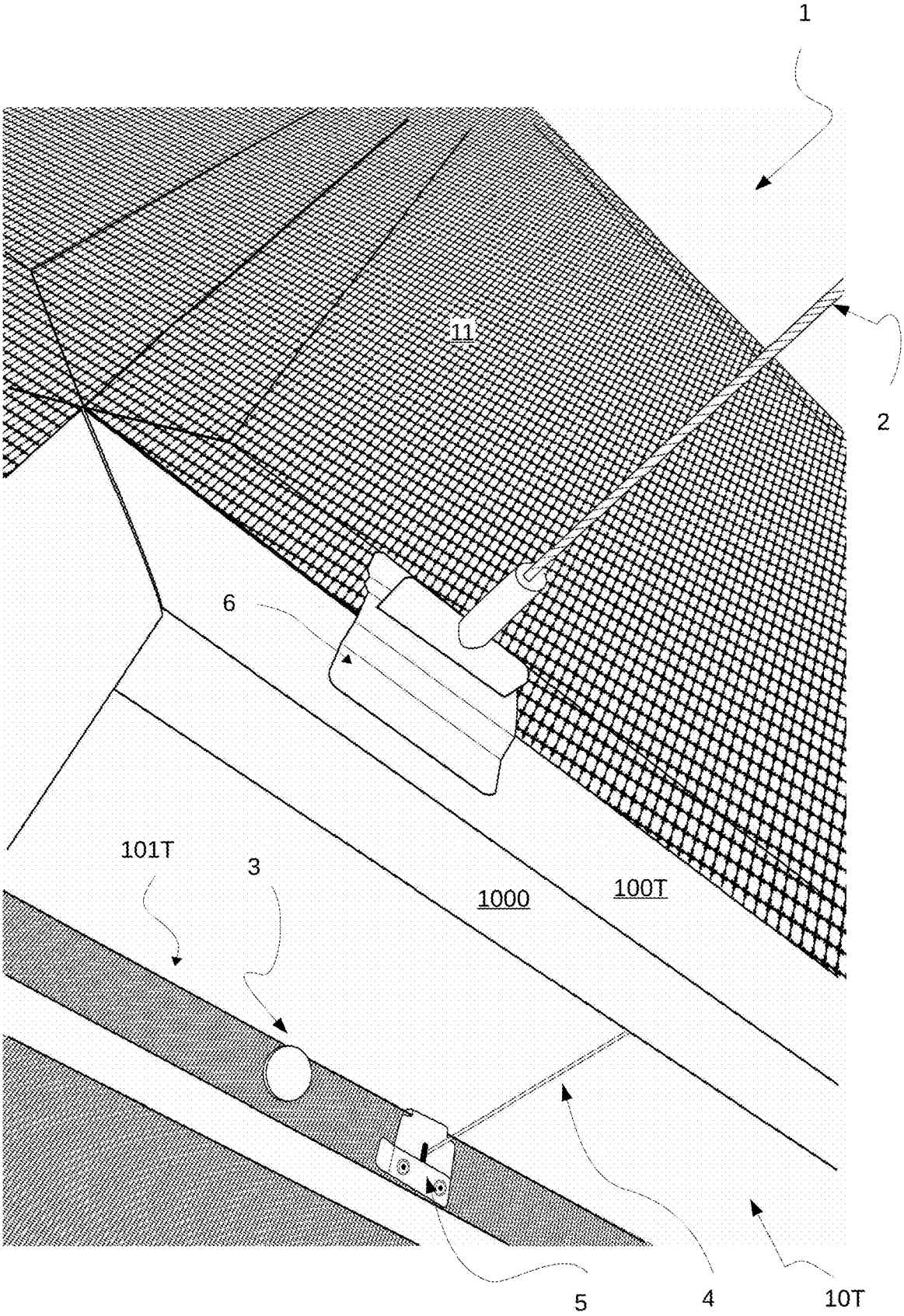
FIG. 2 is a perspective view of a suspended ceiling that has a removable panel of which the opening section is released from the fixed section.

According to the disclosed embodiment, the suspended ceiling 1 comprises moreover at least one removable panel 10T as shown in FIG. 2. The removable panel 10T also has a filter or absorbent function but can be partially released from the rest of the suspended ceiling 1 in order to allow access to the technical plenum, as shall be understood in what follows.

Each removable panel 10T is comprised of a fixed section 100T and of an opening section 101T, said opening section being able to nest into said fixed section reversibly, from below said fixed section in such a way that, when the opening section 101T is nested in the fixed section 100T, the removable panel 10T cannot be distinguished substantially from the other modular panels 10 that the suspended ceiling 1 is comprised of.

Figure 3A:
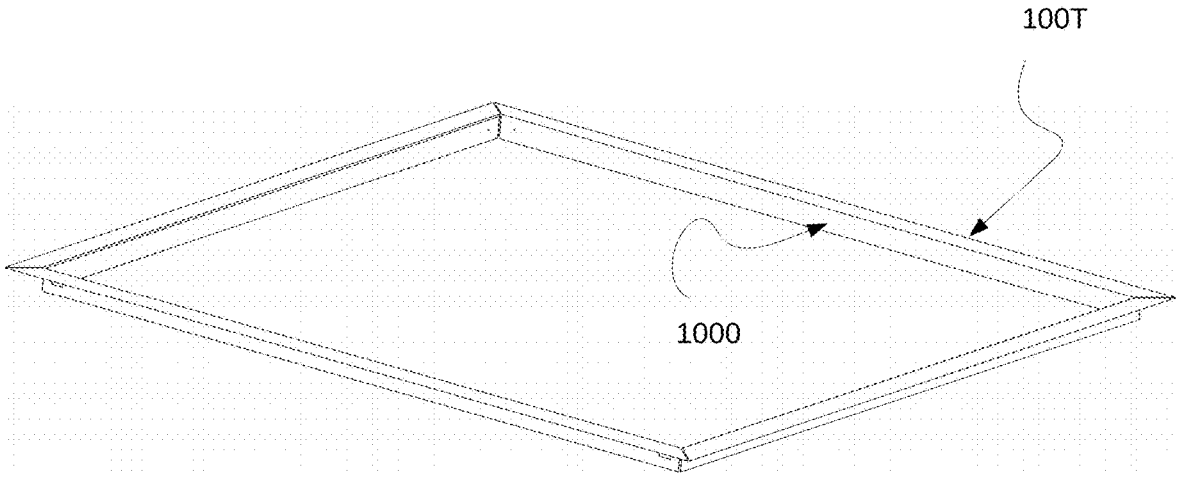
FIG. 3A is a perspective view of a fixed section of a removable panel according to the disclosed embodiment.
Figure 3B:
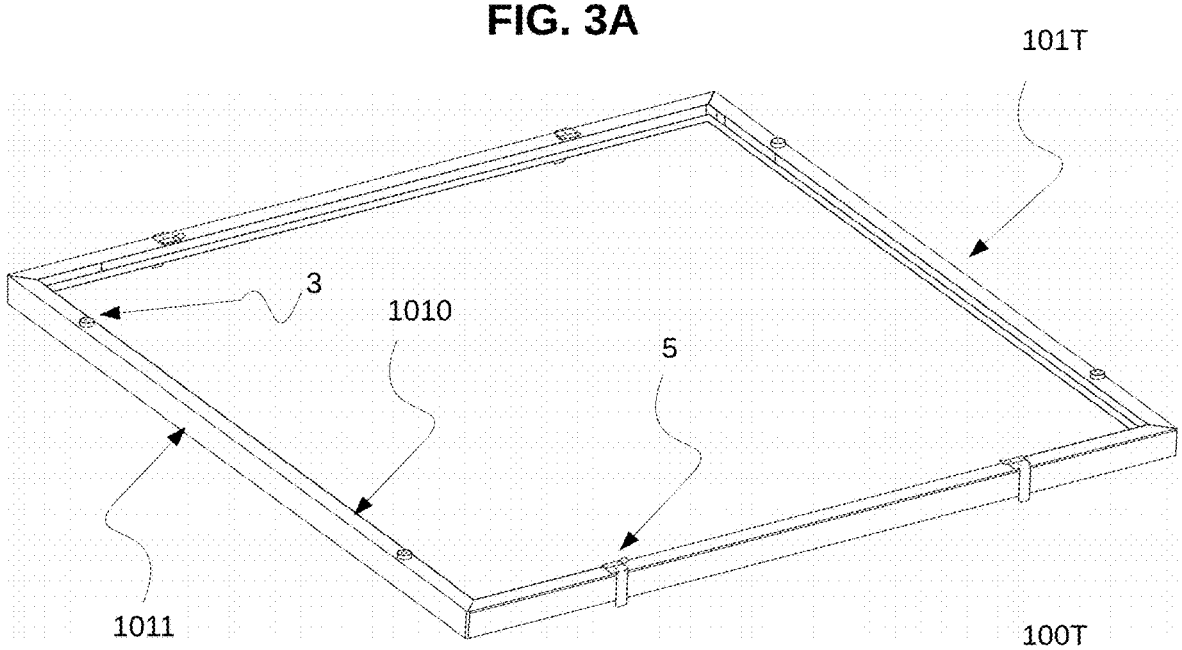
FIG. 3B is a perspective view of an opening section of a removable panel according to the disclosed embodiment.
Figure 3C:
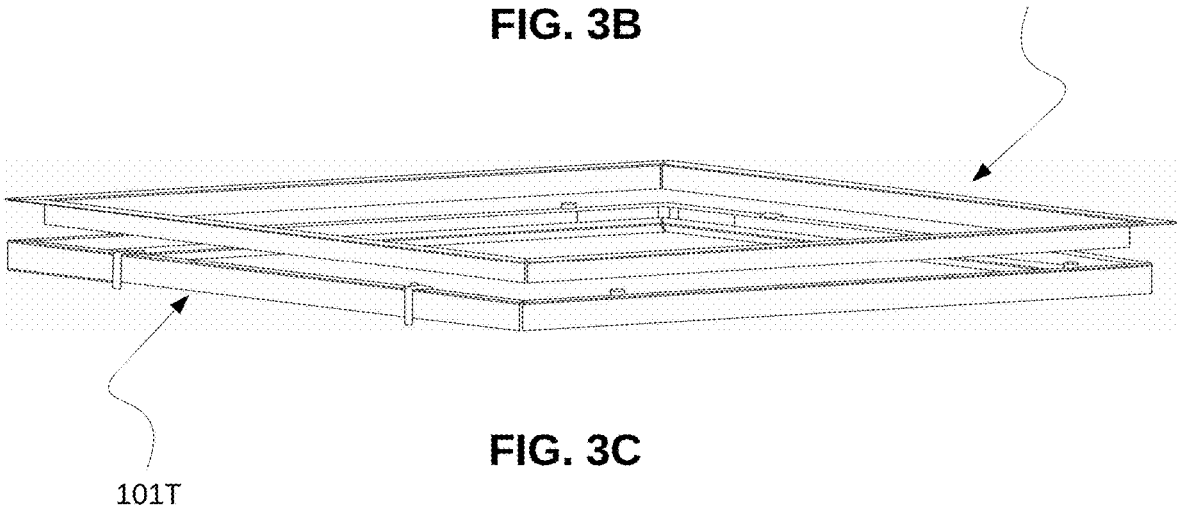
FIG. 3C is a perspective view of the fixed section and of the opening section of FIGS. 3B and 3C.

In reference to FIGS. 3A and 3C, the fixed section 100T is mainly comprised of a rectangular metal frame, referred to in what follows as "fixed section frame", that substantially has the dimensions of another panel 10 of the suspended ceiling 1, and comprising four profiles with a bracket section able to receive the opening section 101T. Those skilled in the art will understand when reading the description that the shape of the removable panel 10T is not limited to the rectangular shape but can also be declined into various geometrical shapes, according in particular to the shape of the other panels of the suspended ceiling 1 wherein it is intended to be integrated.

The fixed section 100T is fastened to the other panels 10 by the same linear junction system 6 as the one used between any two panels 10.

In reference to FIGS. 3B and 3C, the opening section 101T is mainly comprised of a metal frame, referred to in what follows as "opening section frame" that substantially has the dimensions of another panel 10 of the suspended ceiling 1, and comprising four profiles with a bracket section whereon is intended to be stretched the textile adapted to the role that the panel has to play, i.e. filter or absorbent.

Although the sections of the profiles of the fixed section and opening section frames described hereinabove are those of a preferred embodiment, those skilled in the art will understand that they are not limited to the latter. By way of example, the opening section frame could also have the shape of a C-shaped profile.

The opening section 101T is provided with a set of magnets 3 on an upper face 1010 formed by an upper face of all of the profiles of the opening section frame. In FIG. 3B, the magnets 3 are distributed over two parallel profiles of the metal frame, with two of said magnets being placed on a first profile and two other magnets being placed face to face on the parallel profile. In this way, when the opening section 101T is nested in the fixed section 100T, the magnets make it possible to maintain said opening section in said fixed section via a magnetic force exerted by the magnets 3 on the metal frames of the opening section and of the fixed section. A symmetrical distribution of the magnets such as shown allows for a better maintaining of the opening section 101T, however those skilled in the art will understand that the number of magnets and the configuration thereof are not limited to the example shown.

Figure 3D:
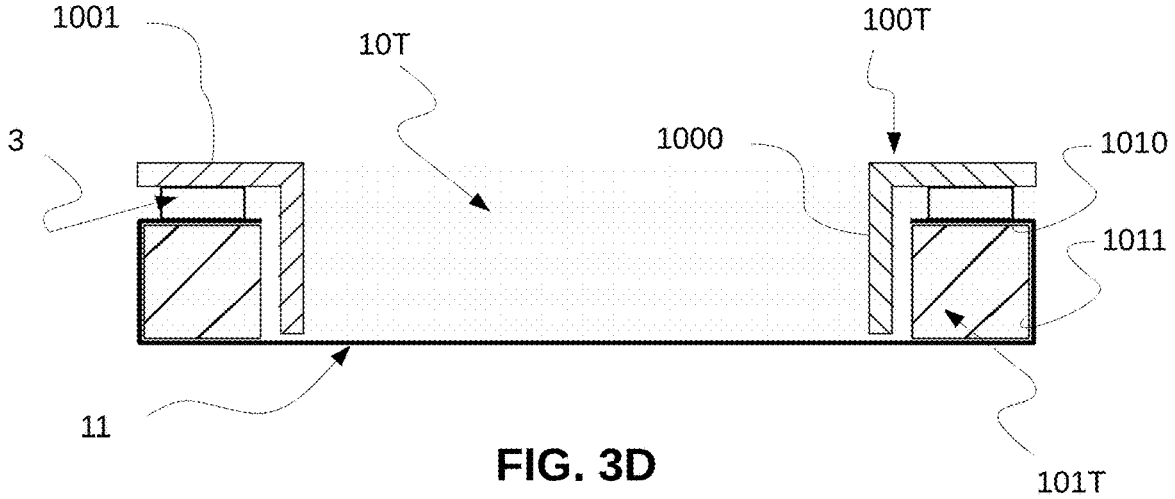
FIG. 3D is a vertical cross-section view of the fixed section and of the opening section nested and maintained together by the magnets.

In reference to FIG. 3D, the textile 11 of the removable panel 10T, shown as a thickened line, is fastened to the upper face 1010 of the opening section 101T and to an outer face 1011 of said opening section substantially perpendicular to said upper face, and said textile is stretched only on a lower portion of the opening section 101T, leaving an upper portion of said opening section free so that the opening section frame can nest into the fixed section frame.

The notions of "lower portion" and "upper portion" here refer to the position of the panel once it is integrated into the suspended ceiling.

Such a configuration of the opening section 101T and of the textile makes it possible to use a metal frame of fixed section 100T of which two sections of profiles are shown in FIG. 3D. The sections shown have the shape of a bracket of which one vertical branch 1000 is placed inside the frame of the opening section 101T.

Figure 3E:
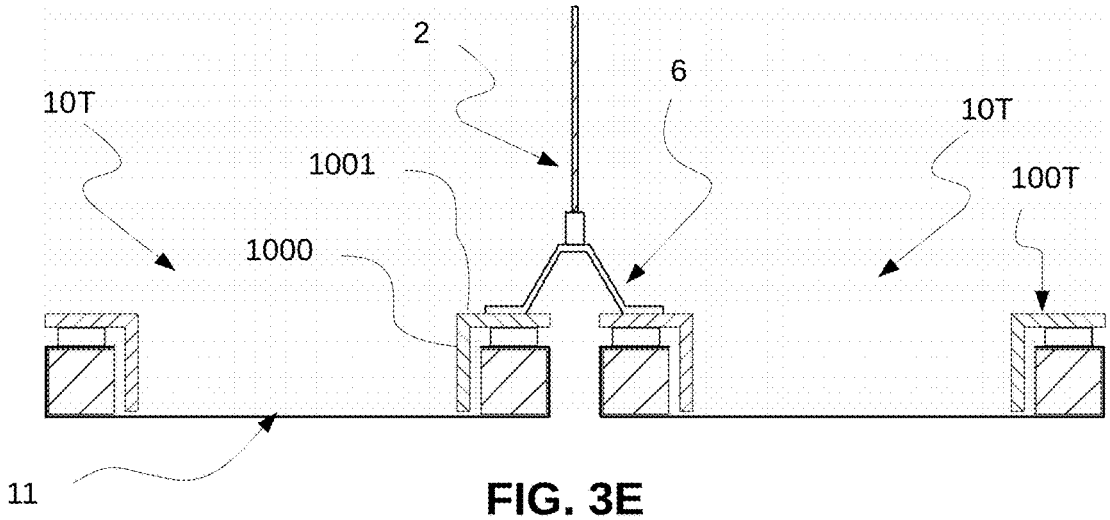
FIG. 3E is a vertical cross-section view of the fixed sections and opening sections of two adjacent removable panels connected together by a linear junction system.

In reference to FIG. 3E, two fixed sections 100T of two adjacent removable panels 10T have two horizontal branches 1001 of the metal frame face to face. This has two advantages:

- on the one hand, the space between the panels is better controlled because, as the vertical portions of the profiles of the fixed section frame do not interfere, due to their thickness, with the adjusting of the distance between the panels, which allows for more freedom in the adjusting of the space between the panels;
- on the other hand, the fixed sections cannot be seen between the panels by an individual moving about in the room comprising the suspended ceiling.

Although FIG. 3E shows two removable panels 10T, these considerations are also valid for two non-removable adjacent panels or a removable panel 10T adjacent to a non-removable panel.

Figure 3F:
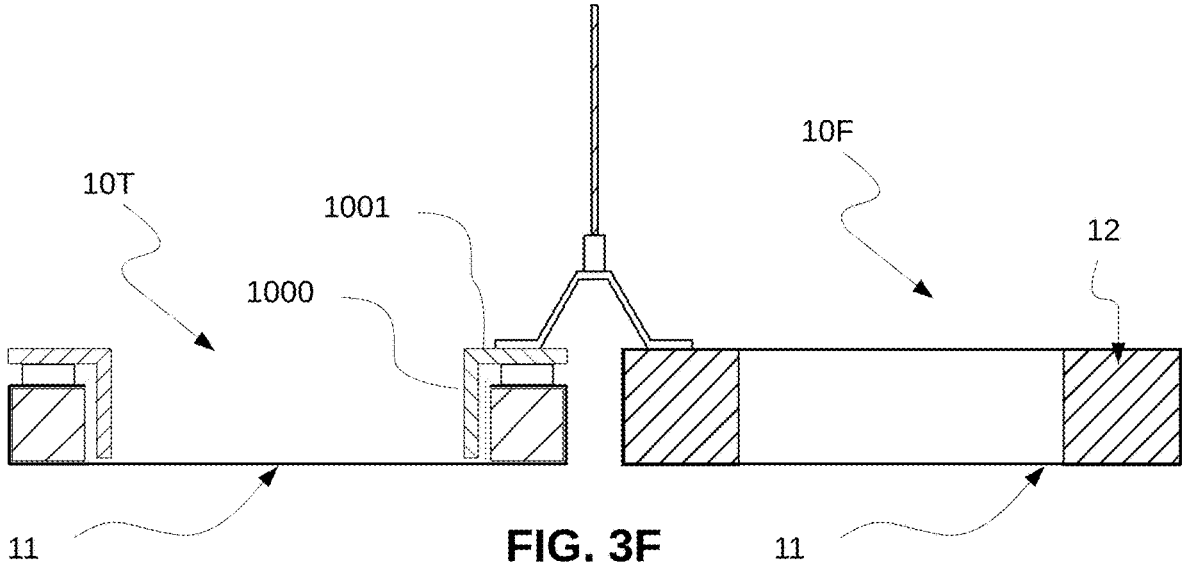
FIG. 3F is a vertical cross-section view of the fixed sections and opening sections of two adjacent panels connected together by a linear junction system, with one of the panels being a removable panel and the other panel not being removable.

By way of example, FIG. 3F shows a vertical cross-section view of two adjacent panels, with the one on the left being a removable panel 10T, and the one on the right a non-removable filter panel 10F. In this configuration, it appears that the configuration of the bracket profile of the fixed section frame of the removable panel makes it possible to control the space between the two panels since the vertical branch 1000 of the profile does not interfere with the management of this space. Moreover, it appears in FIG. 3F that the non-removable panels can be entirely covered with textile without preventing the implementation of the disclosed embodiment.

The fixed section 100T and the opening section 101T are also connected together by a set of slings 4. In the embodiments of the disclosed embodiment shown in the figures, four slings 4 are intended to connect the fixed section 100T and the opening section 101T. The slings 4 are fastened to the fixed section 100T and to the opening section 101T in such a way as to limit the falling of the removable panel 10T when the latter is not maintained nested in the fixed section 100T.

A set of safety devices 5 is also arranged on the opening section 101T.

Figure 4A:
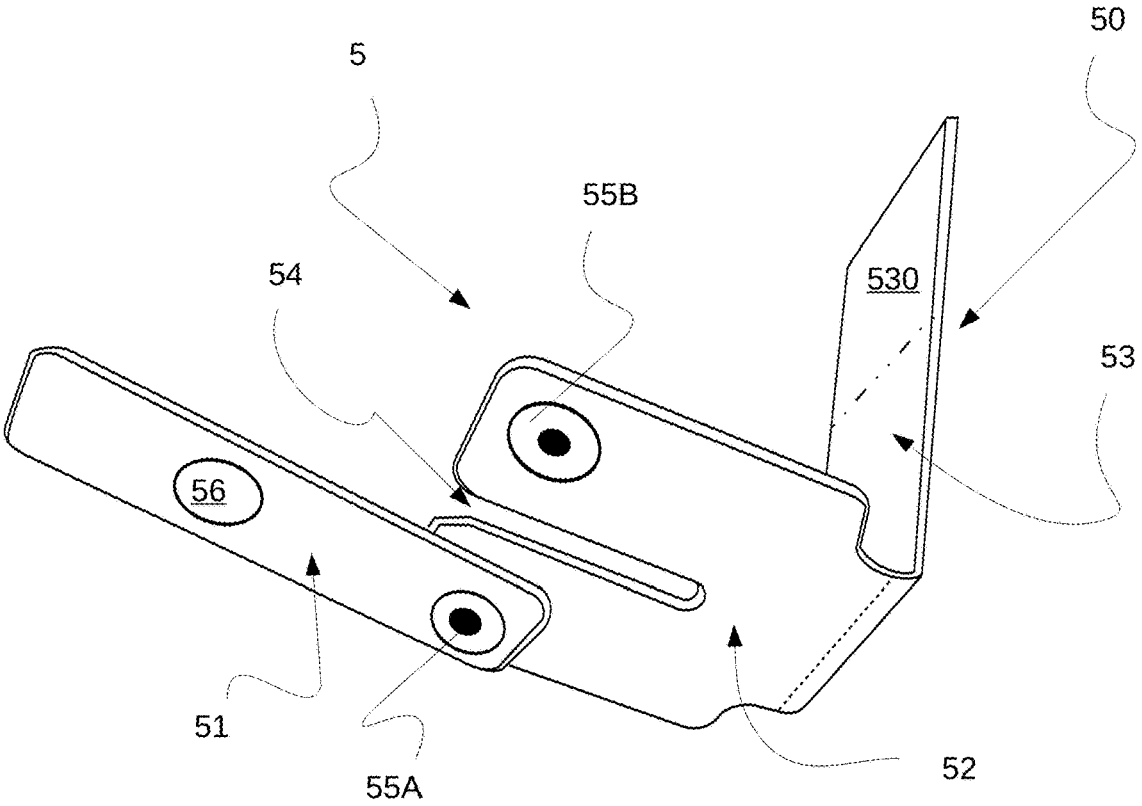
FIG. 4A is a perspective view of a safety device according to the disclosed embodiment in the open or unlocked position.
Figure 4B:
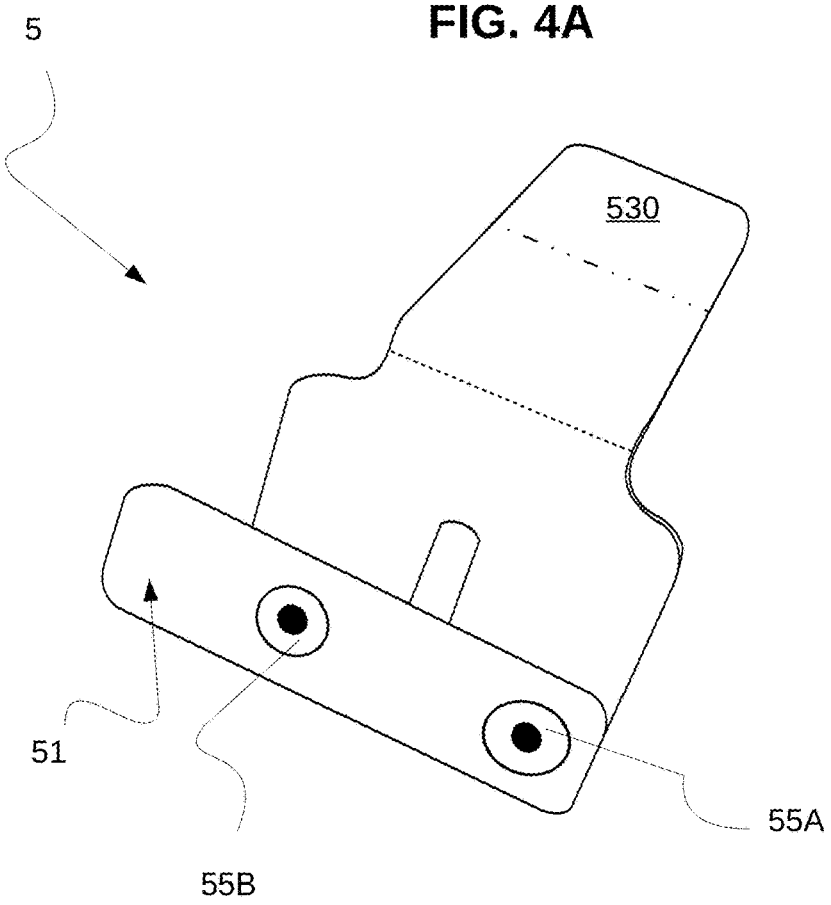
FIG. 4B is a perspective view of a safety device according to the disclosed embodiment in the closed or locked position.

In reference to FIGS. 4A and 4B, a safety device 5 according to the disclosed embodiment comprises a body 50 and an arm 51. The body 50 is a metal part of a single piece, of which a fastening portion 52 forms with a handling portion 53 an angle of about 90°. The fastening portion 52 is substantially flat and has a groove 54 according to an axis that is substantially perpendicular to the plane of the handling portion 53. Rivets 55A, 55B are arranged on either side of said groove, in particular, one of the rivets 55A makes it possible to permanently fasten the arm 51 to the body 50 by a first end of said arm, in such a way that the arm 51 is then able to pivot about the axis of said rivet via a manual action. The safety device 5 can thus switch from an open (or not locked) position shown in FIG. 4A to a closed (or locked) position shown in FIG. 4B, wherein the free rivet 55B is engaged in a hole 56 of the arm 51 in order to block the movement of said arm. Inversely, the safety device 5 can be switched from a closed (or locked) position to an open (or unlocked) position by disengaging the arm 51 from the free rivet 55B.

In reference to FIG. 3B, four safety devices 5 are distributed face to face on the two parallel profiles of the opening section 101T that do not comprise any magnet. The fastening portion 52 is positioned and fastened flat on the upper face 1010 of the metal frame of the opening section 101T and the handling portion 53 is flat on the outer face 1011 of said metal frame. The dimensions of the safety device 5 are such that said device substantially fits closely the shape of the metal frame.

The dimension of the handling portion 53 is large enough so that, when the opening section 101T is set into place in the fixed section 100T, a gripping portion 530 of the handling portion 53 protrudes and can thus be located visually. This gripping portion 530 is delimited fictitiously by dot/dash lines in the FIGS. 4A and 4B. This gripping portion 530 makes it possible to facilitate the releasing of the opening section 101T from the fixed section 100T.

Figure 4C:
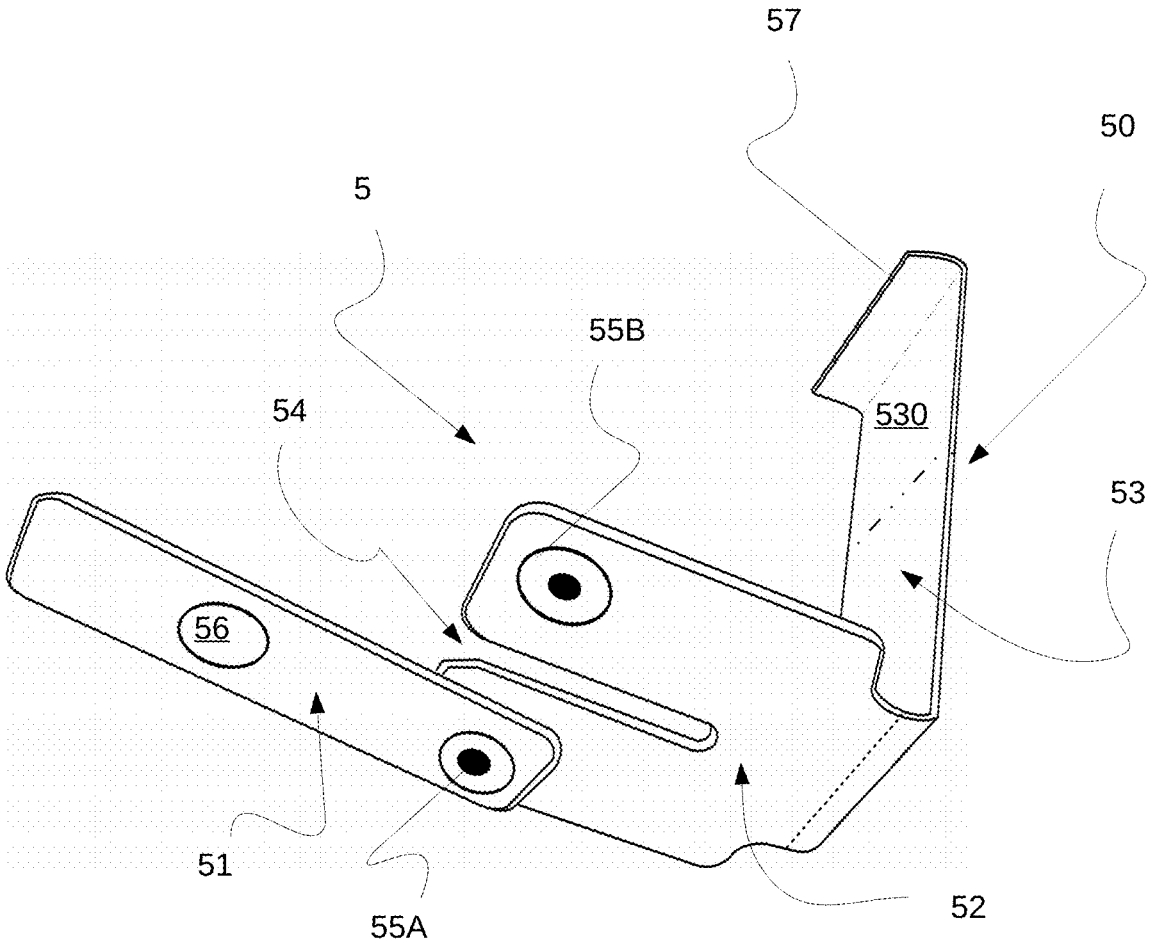
FIG. 4C is a perspective view of a safety device according to the disclosed embodiment, in the open or unlocked position, in an alternative embodiment.

In an embodiment shown in FIG. 4C, the gripping portion 530 has at a free end a means for grasping 57. In the example shown, the means for grasping is a fold forming an angle substantially equal to 90° with the rest of the gripping portion 530, but this example is not limiting and other means could be considered, for example a hook. In any case, the means for grasping 57 extend globally in a direction substantially parallel to the fastening portion 52, i.e. globally perpendicularly to the rest of the gripping portion 530.

Preferably, the means for grasping 57 extend in the same direction as the fastening portion 52 in relation to the handling portion 53, in order to prevent a safety device 5 from interfering with another safety device 5, in the case where two removable panels would be installed side by side in the suspended ceiling 1.

In an embodiment, holes are made in the handling portion 53, for example on where dash lines are appearing in the FIGS. 4A and 4B, in order to weaken said handling portion and allow an operator to detach all or a portion of the handling portion 53 in the case where it would not be distinguished from the rest of the suspended ceiling 1.

Figure 5A:
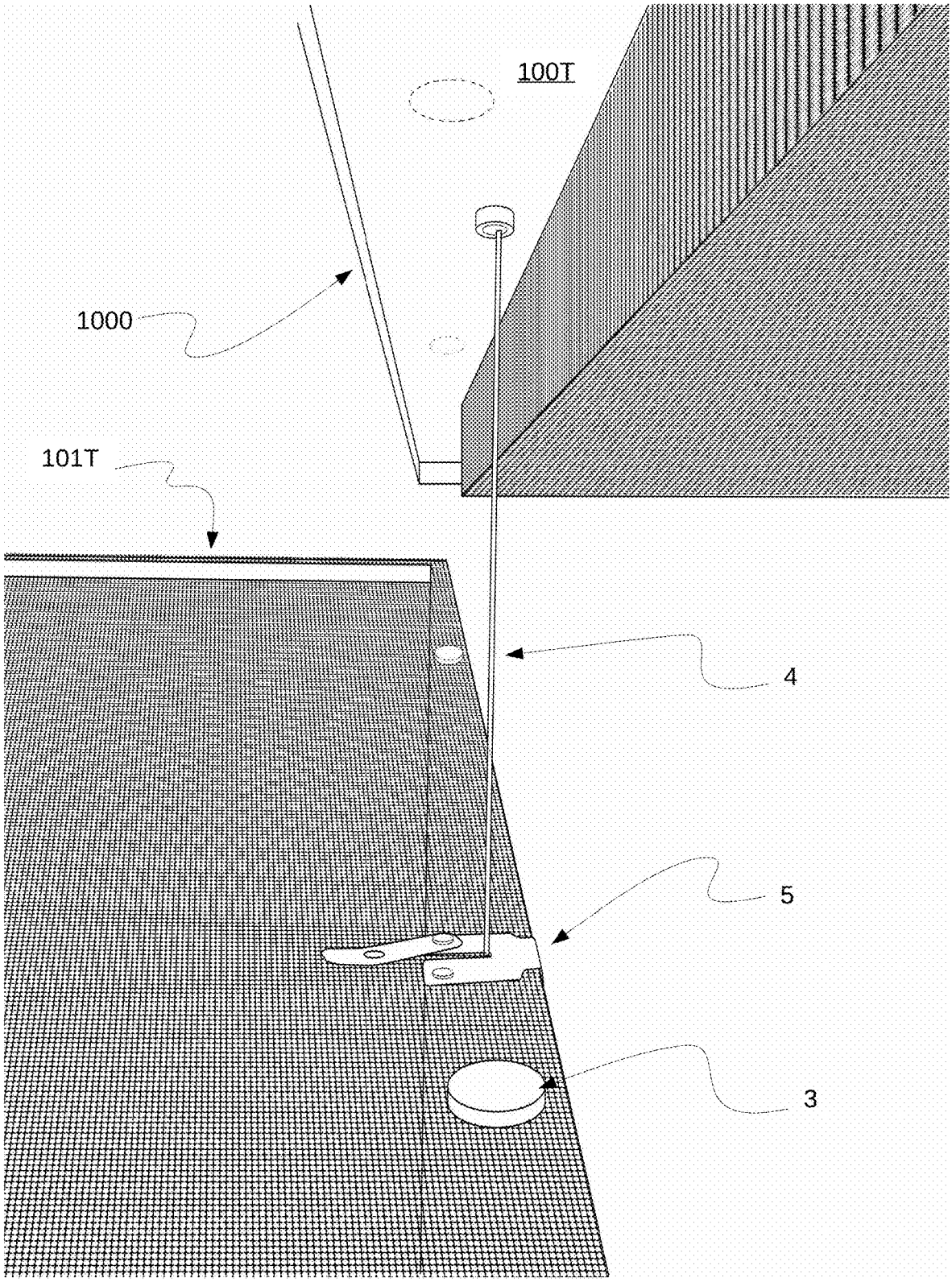
FIG. 5A is a perspective view of a portion of a removable panel according to the disclosed embodiment, integrated into a suspended ceiling, of which the opening section is released from the fixed section and a safety device is in the open or unlocked position.
Figure 5B:
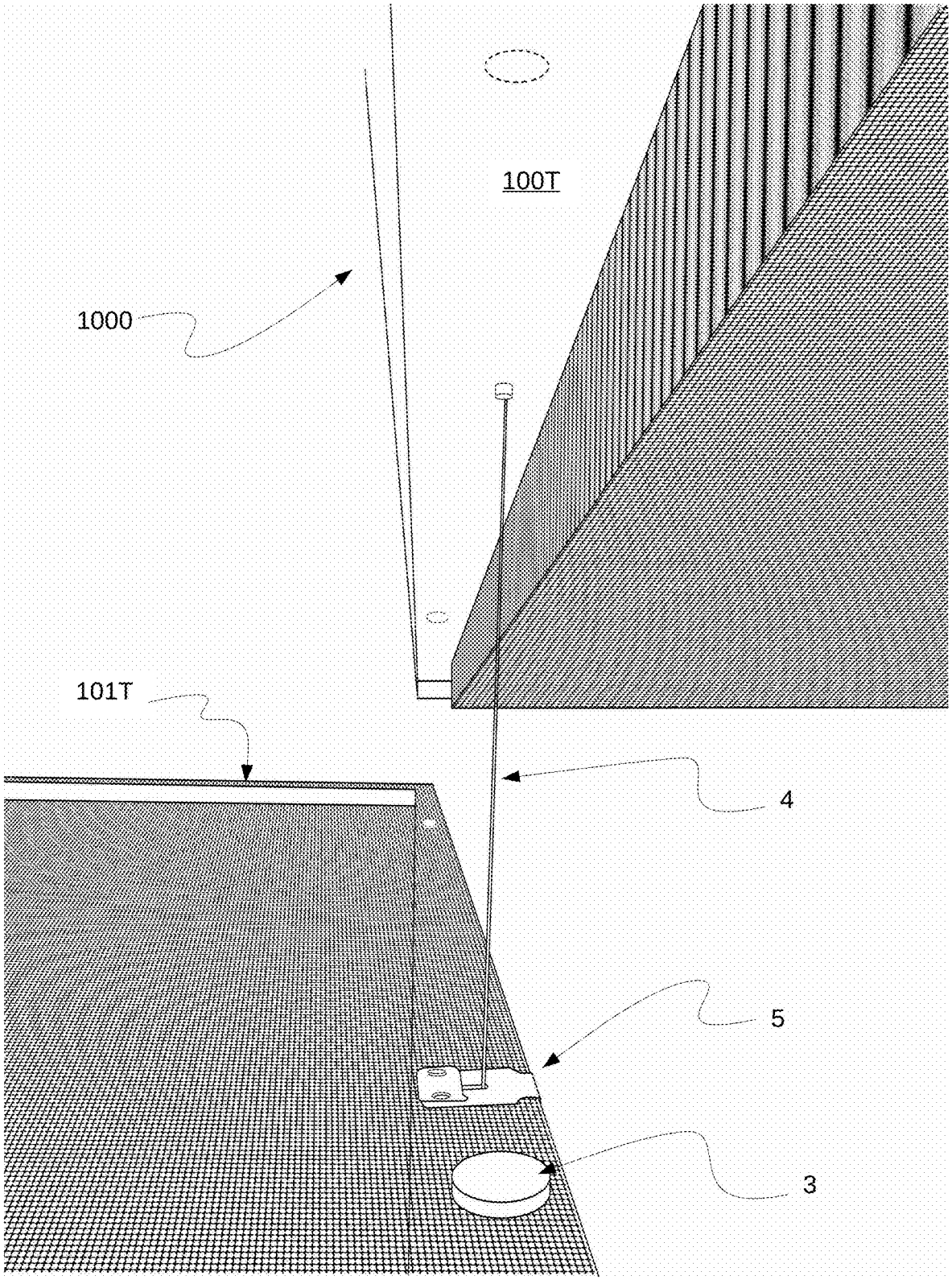
FIG. 5B is a perspective view of a portion of a removable panel according to the disclosed embodiment, integrated into a suspended ceiling, of which the opening section is released from the fixed section and a safety device is in the closed or locked position.

As shown in FIGS. 5A and 5B, during the installation of the opening section 101T, each sling 4 fastened beforehand on the fixed section 100T installed in the suspended ceiling 1 is inserted into the groove 54 of a safety device 5 in the open position. The sling 4 is then reversibly fastened to the opening section 101T, then the associated safety device 5 is locked, i.e. placed in the closed position, in order to prevent the sling 4 from exiting the groove 54.

Conventionally, the sling 4 comprises a cable, intended to be slid into the groove 54 of the safety device 5, and a component at each of the ends of said cable, for example a ring or a hook, allowing for the fastening of the sling to the fixed section 100T on the one hand, and to the opening section 101T on the other hand.

The exiting of the sling from the groove 54 is prevented on the one hand by the arm 51 of the safety device 5 placed in closed position, and on the other hand by dimensions of the component forming an end of the sling, which dimensions are large enough to prevent a passing of said component through said groove.

It should be noted that a single sling is shown in FIGS. 5A and 5B.

The opening section 101T is then nested into the fixed section 100T, and maintained in the latter by the magnets. The interrupted lines shown on the fixed section, in FIGS. 5A and 5B, show an imprint of each one of the magnets 3 on the fixed section 100T when they are in contact with said fixed section. A thickness of the magnets 3 makes it possible to create, when the opening section is maintained nested in the fixed section 100T, a space between the frame of the fixed section 100T and the frame of the opening section 101T wherein the slings 4 can be placed, in such a way that these slings cannot be seen by an individual located under the panel 10.

When an operator wants to release the opening section 101T from the fixed section 100T, for example in order to access the ventilation network, he grasps the gripping portions 530 of the safety devices 5 in order to be able to pull on said device in order to offset the magnetic force of the magnets 3 that make it possible to maintain the opening section 101T in the fixed section 100T.

In the case where the safety device 5 has a means for grasping 57 such as described hereinabove and shown in FIG. 4C, said means for grasping facilitates the grasping by the operator, in particular if the operator has greasy or wet hands.

When the opening section 101T is released from the fixed section 100T, the safety devices 5 can be unlocked in order to detach the slings 4 of said opening section, which can then be freely manipulated, and in particular removed in order to allow for access to the plenum.

It should be noted that, for safety reasons, if the safety device 5 is in the open position, the arm 51 prevents the nesting of the opening section 101T in the fixed section 100T. This function is provided by the bracket shape of the metal frame of said fixed section. Indeed, as can be understood in FIG. 5A, if the opening section 101T is installed while at least one of the safety devices 5 is in the open position, then the arm 51 of the at least one of the devices 5 will abut against the vertical branch 1000 of the fixed section 100T, substantially vertical when said fixed section is installed in the suspended ceiling 1, thus preventing the setting in place of said opening section.

What is claimed is:

1. A removable panel comprising:

a fixed section comprising a metal fixed section frame;

an opening section comprising a metal opening section frame configured so as to be reversibly nested in said fixed section;

at least one magnet configured to position said opening section reversibly nested in said fixed section;

at least one sling fastened to said fixed section at a first end and reversibly fastened to said opening section at a second end; and at least one safety device configured to ensure fastening of the at least one sling to the opening section, said safety device comprising:

a unitary body comprising a fastening portion and a handling portion that are substantially flat, said fastening portion and handling portion being arranged to substantially form about an angle of 90° relative to each other, said fastening portion being fastened to the opening section and having a groove that extends perpendicularly to a plane of said handling portion, said groove having two sides with rivets being arranged on either side of said groove;

an arm fastened at a first end of said arm to the body by means of one of the rivets such that the arm pivots about an axis of said rivet in order to switch from an open position, in which the another of the rivets is engaged in a hole of said second end of said arm or inversely from said closed position to said open position.

2. The removable panel according to claim 1, wherein the safety device comprises a gripping portion which allows an operator to grasp said safety device in order to release the opening section from the fixed section when said opening section is nested in said fixed section.

3. The removable panel according to claim 2, wherein the gripping portion has, at a free end of said gripping portion, a means for grasping extending substantially perpendicularly to a remainder of said gripping portion.

4. The removable panel according to claim 1, wherein the fixed section has a bracket section.

5. A suspended ceiling comprising a set of modular panels wherein the suspended ceiling comprises the removable panel of claim 1.

6. The suspended ceiling according to claim 5, wherein the suspended ceiling is an acoustical suspended ceiling and the modular panels as well as the at least one removable panel are one of:

an aerated filter panel comprised of a metal armature covered with a perforated textile cover stretched over said armature, or an absorbent panel comprised of a metal armature that supports an absorbent wadding and a microporous veil, the metal armature, absorbent wadding, and microporous veil forming a whole covered with a textile cover.

7. The suspended ceiling according to claim 6, wherein the modular panels are maintained together by linear junction systems that provide a flatness of said suspended ceiling.

8. The suspended ceiling according to claim 5, wherein the modular panels are retained together by linear junction systems that provide a flatness of said suspended ceiling.

* * * * *